United States Patent [19]

Sanner

[11] 4,417,133

[45] Nov. 22, 1983

[54] FUEL TANK HAVING AN IMMERSION HEATING ELEMENT ASSEMBLY

[76] Inventor: Johnny W. Sanner, P.O. Box 216, Billings, Mont. 59103

[21] Appl. No.: 237,584

[22] Filed: Feb. 24, 1981

[51] Int. Cl.[3] ..... H05B 1/02; H05B 3/82; F24H 1/20

[52] U.S. Cl. ..... 219/316; 219/205; 219/208; 219/306; 219/318; 219/336; 219/523; 338/233; 338/271; 338/274

[58] Field of Search ..... 219/316, 318, 319, 335, 219/336, 306, 337, 523, 205, 208, 328, 331; 338/229, 233, 237, 271, 273, 274

[56] References Cited

U.S. PATENT DOCUMENTS

| | | | |
|---|---|---|---|
| 1,689,198 | 10/1928 | Gagelman | 219/316 X |
| 1,858,003 | 5/1932 | Downey | 219/523 X |
| 2,389,925 | 11/1945 | Morgan et al. | 219/205 |
| 2,839,660 | 6/1958 | Davies | 219/337 X |
| 2,888,546 | 5/1959 | Kinney | 219/316 |
| 3,371,192 | 2/1968 | Rosenel | 219/523 |
| 3,519,795 | 7/1970 | Kinney | 219/316 X |
| 3,560,707 | 2/1971 | Kolfertz | 219/335 X |

FOREIGN PATENT DOCUMENTS

| | | | |
|---|---|---|---|
| 1143940 | 2/1963 | Fed. Rep. of Germany | 219/523 |
| 1477689 | 3/1967 | France | 219/523 |
| 358519 | 1/1962 | Switzerland | 219/523 |
| 218393 | 7/1924 | United Kingdom | 219/319 |

*Primary Examiner*—Anthony Bartis
*Attorney, Agent, or Firm*—Harvey B. Jacobson

[57] ABSTRACT

A fuel tank is provided with an electric immersion heating element assembly directly immersible in the fuel within the tank and resting on the curved tank bottom. The assembly includes an elongated, cylindrically shaped, solid aluminum heater body having a longitudinally extending cavity in each end thereof closed by a resilient plastic end cap of larger diameter than the body and secured thereto by a snap fit rib and groove connection. One of the cavities has an inward axial extension in which is received an electric heating element with one end of the heating element electrically connected to the body at the inner end of the extension. An adjustable thermostatic switch is located in the other cavity and is electrically connected in series with the other end of the heating element and with one wire of a flexible power supply conduit extending in sealed relation through the end cap closing the other cavity. The other wire of the power supply conduit is connected to the body within the other cavity to complete the electrical circuit to the heating element.

2 Claims, 2 Drawing Figures

FUEL TANK HAVING AN IMMERSION HEATING ELEMENT ASSEMBLY

BACKGROUND OF THE INVENTION

1. Field of the Invention

The present invention relates to a fuel tank having an immersion heating element assembly and more particularly pertains to a new and improved fuel tank immersion heating element assembly which is directly immersible into a supply of fuel contained within a tank and rest on the bottom of the tank.

2. Description of the Prior Art

The use of fuel heaters is generally well known in the art. However, most of the prior art fuel heaters are designed for insertion into existing fuel supply lines whereby the fuel is heated during its flow from a fuel supply tank to an internal combustion engine or some other type of fuel consuming device. In this respect, no provision is generally made for heating fuel while it is still contained in a fuel supply tank due to the large amount of heat normally required to maintain the fuel at an elevated temperature. This present problems, however, since some fuels, such as diesel fuel or the like, tend to gel in low temperature weather whereby it becomes very difficult to draw the fuel out of a supply tank for an intended use.

To overcome this problem, there has been at least one attempt to manufacture an electrically powered immersion heater which is designed to be permanently attached to a fuel supply tank. In this connection, reference is made to U.S. Pat. No. 2,266,985, issued to Morgan et al on Dec. 23, 1941, wherein there is disclosed an electric immersion heater which is specifically intended to be used for heating the oil in aircraft. However, the Morgan device is designed as an attached semi-permanent or permanent part of the aircraft and accordingly, it must be removed from the filler hole each time oil is added to the aircraft. This, of course, creates problems in that it becomes a complex operation to simply add oil to the aircraft, thus presenting the danger that mechanics or other maintenance personnel will be dissuaded from adding the needed oil due to the trouble involved. As such, there still exists a need for a fuel oil tank heater which may be easily installed within a fuel oil supply tank, which is efficient and dependable in its operation, and which presents no additional problems for personnel attempting to add a supply of fuel oil to the tank. In this respect, the present invention substantially fulfils this need.

SUMMARY OF THE INVENTION

The general purpose of the present invention, which will be described subsequently in greater detail, is to provide a fuel oil tank and heater that has all the advantages of similarly employed prior art heaters and has none of the above-described disadvantages. To attain this, the present invention provides a cylindrically shaped, solid aluminum heater body having a heating element sealingly contained therein, such heater body being immersible within a supply of fuel oil contained within a supply tank. The heater body is freely movable within the tank and is cushioned from direct contact with the tank bottom through the use of a pair of circumferentially extending buffers positioned on opposed ends of the body. A power supply line is directed from an outside power source to the heater, and the amount of power provided to the heating element is thermostatically controlled through the use of a thermoswitch which is also sealingly contained within the heater body.

An object of the present invention is to provide a fuel tank heater that is both simple in construction and limited in the number of moving parts, may be easily and economically manufactured, may be used on the fuel tanks of diesel trucks and tractors during cold weather operation, causes no interference with standard gauges and fuel filling or withdrawing systems, is efficient and reliable in its operation, and either temporarily or permanently installed in a fuel tank.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
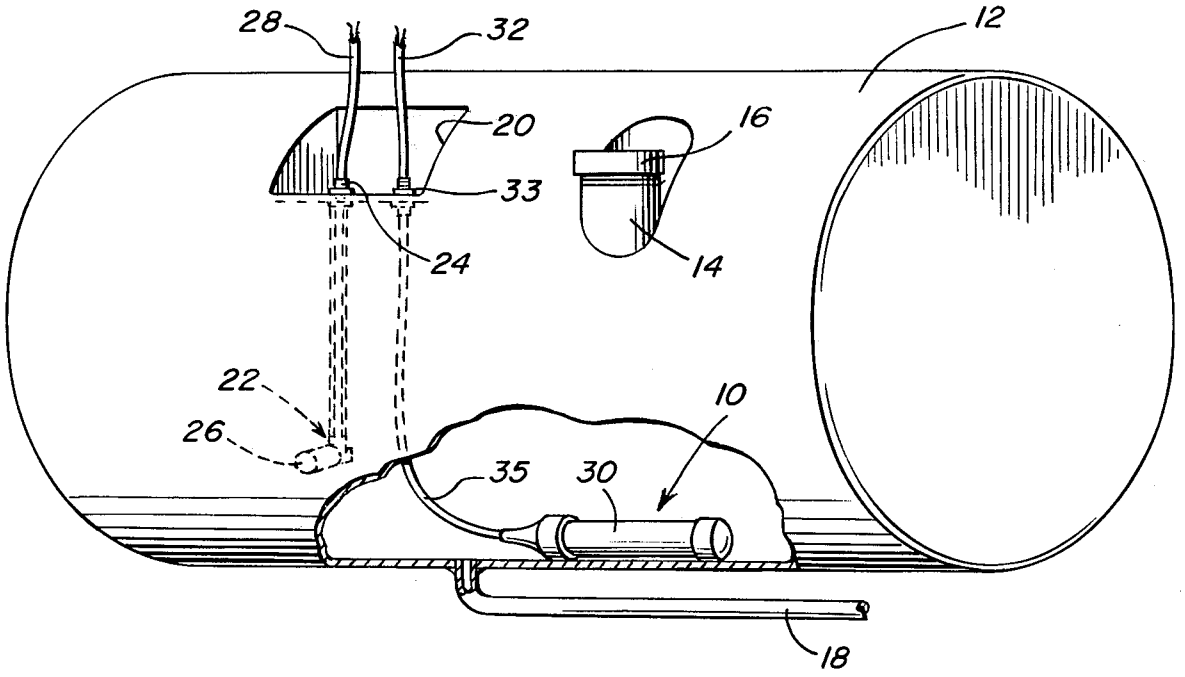
FIG. 1 is a perspective view of the fuel tank and immersion heating element assembly forming the present invention operably installed within the fuel tank.

With reference now to the drawings and in particular to FIG. 1 thereof, a fuel tank heating element assembly embodying the principles and concepts of the present invention and generally designated by the reference numeral 10 will be described in detail. In this respect, the fuel heater 10 is illustrated as being operably positioned within a cylindrical fuel tank 12, such fuel tank including a fuel filler pipe 14 having a closure cap 16 screwably attached thereto and further including a bottom fuel outlet pipe 18. In this regard, the construction of the fuel tank 12 is conventional in nature. The construction of the fuel tank 12 further includes a recess 20 which is provided for the purpose of facilitating the attachment of a fuel gauge 22 to the fuel tank. The construction of the fuel gauge 22 is conventional and includes a sealing ring 24, a conventional float 26 and a connection lead 28 for sending an appropriate signal indicative of the amount of fuel contained within the tank. Further illustrated in FIG. 1 is the fact that the fuel tank heating element assembly 10 includes a heater body 30 which is of a cylindrical shape and which is provided with an electrical connection lead 32 directed thereto. In this respect, the connection lead 32 is utilized to provide electrical power to the assembly 10 and is directed outwardly from the tank 12 to an external power source which is not illustrated. The connection lead 32 is directed through an aperture contained within the recess 20 and is sealingly connected to the tank 12 through the use of a sealing ring 33. In this connection, the sealing ring 33 permits the attachment of a flexible length of conduit or tubing 35 between the recess 20 and the heater assembly 10. As such, the electrical connection lead 32 may be encased within the flexible conduit 35 whereby the lead will not be exposed to any corrosive action of the fuel oil contained within the tank 12.

Figure 2:
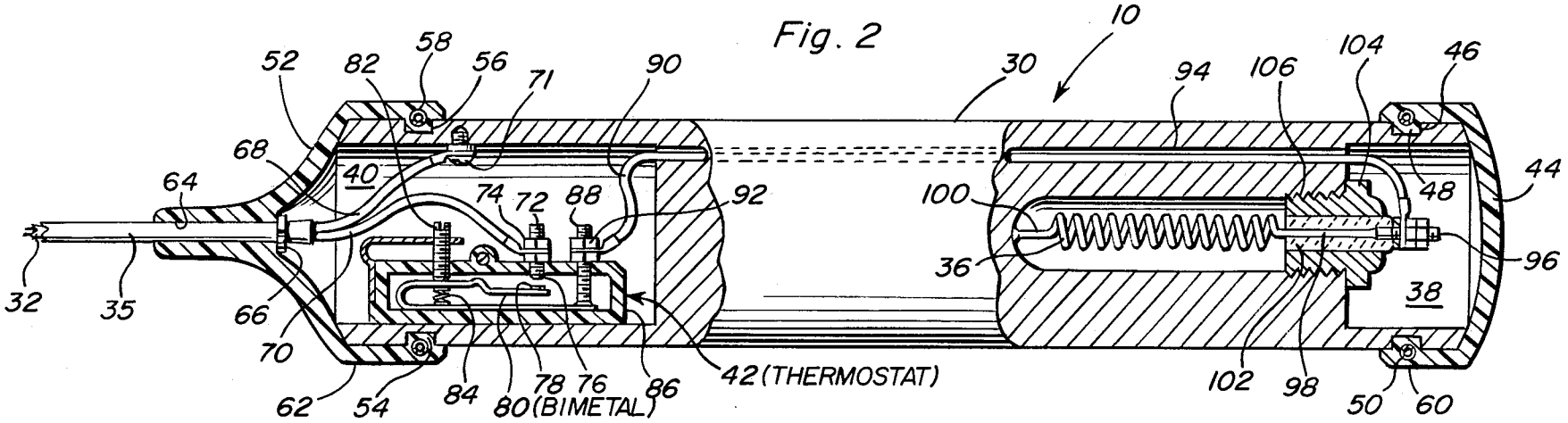
FIG. 2 is a longitudinal plan view, partly in cross section, illustrating the structural details of the heating element assembly.

Referring now to FIG. 2 of the drawings, a better understanding of the construction of the assembly 10 can be ascertained. In this regard, it can be seen that the assembly 10 includes the aforementioned heater body 30, which might typically be constructed of aluminum, or some other electrically and thermally conductive material, and further includes a heating element 36 positioned within the heater body. Specifically, the heater body 30 is of a cylindrical shape and has a first hollow cavity 38 positioned at one end thereof and a second hollow cavity 40 contained in the other end. The heating element 36 is operably positioned within the first hollow cavity 38, while a thermoswitch 42 is positioned in the second hollow cavity 40. In this respect, it can be seen that the interior portion of the cavity 38 is sealed from contact with fuel oil contained within the fuel tank 12 through the use of a snap-on plastic end cap 44 which is positionable over an end of the heater body 30. Specifically, the heater body 30 may be provided with a circumferentially extending groove 46, and the end cap 44 may be provided with a coacting circumferentially extending ridge 48, such ridge being engageable within the circumferentially extending groove 46 in the manner illustrated. A tension spring 50 may be molded within the end cap 44 in the area proximate to the circumferentially extending ridge 48 to thereby insure a secure snap-on fit of the cap to the body 30.

Similarly, a second plastic end cap 52 may be provided on the other end of the heater body 30 to effectively seal the interior of the hollow cavity 40 from contact with fuel oil contained within the fuel tank 12. Specifically, the end cap 52 may be similarly provided with an inwardly extending circumferential ridge 54 designed for engagement with a circumferentially extending groove 56 positioned on the heater body 30. The ridge 54 may have a tension spring 58 moldably contained therein in the manner of the ridge 48, as contained on the first end cap 44, thereby to insure a firm and secure snap-on fit of the end cap 52 to the heater body 30.

As can be further ascertained with reference to FIG. 2 of the drawings, the end caps 44 and 52 are both of a greater diameter than that of the cylindrically-shaped heater body 30, whereby it can be seenthat only the outer peripheral surfaces 60, 62 associated with the respective caps 44, 52 will contact the bottom of a fuel tank 12 when the heating element assembly 10 is immersed therein. Inasmuch as the heater body 30 will typically be constructed of a metal such as aluminum, the plastic caps 44, 52 serve as buffers which cushion the impact of the heater assembly 10 on the bottom of a fuel tank 12 when the heater assembly is immersed therein. In other words, the soft plastic construction of the end caps 44, 52 serves to cushion the impact so as to minimize the risk of damage to the heater assembly 10 during its insertion into a fuel tank 12. End cap 52 is also illustrated as having a through-extending aperture 64 which is axially aligned with the heater body 30 and through which the flexible conduit 35 may be sealingly directed. In this regard, a conduit 35 may be directed through the aperture 64 and then retained relative thereto through the use of a retaining ring 66 so as to provide the aforementioned sealed connection. As such, the electrical lead 32, which includes both a ground lead 68 and a power or hot lead 70 may be directed into the cavity 40 without coming into contact with the fuel contained within the tank 12.

Assuming that the heater body 30 is constructed of aluminum, which is an electrically conductive material, the ground lead 68 may be directly attached thereto through the use of conventional attachment means, such as screw 71. On the other hand, the power lead 70 is electrically connectible to a first terminal 72 which forms a part of the thermoswitch 42. In this connection, the terminal 72 may be of a threaded construction whereby the hot lead 70 may be positioned thereover and a nut 74 may be threaded downwardly over the terminal to effect a connection between the terminal and the hot lead. As further illustrated in FIG. 2, the first terminal 72 includes an electrical contact surface 76 which is proximate to and facing a second contact surface 78 whereby an electrical connection is completed when the two surfaces 76, 78 are in an abutting relationship. The second contact 78 is fixedly secured to a bimetallic contact arm 80 which, as is well known in the art, will effect relative movement between the contacts 76, 78 in response to temperature changes. In this respect, the heating circuit of the present invention is operable when the two contacts 76, 78 are in an abutting or closed relationship, while the heating circuit is inoperable when the two contacts are in a spaced apart or open relationship. As can be appreciated, the open or closed relationship of the contacts 76, 78 is strictly a function of temperature and is variable through the use of an adjusting screw 82 which is directed through an aperture contained within the thermoswitch 42 and which operates to change the distance between the contacts 76, 78, thereby to vary the temperature range over which the contacts are either in a closed or open relationship. Further, it can be seen that a spring 84 may be provided to insure contact between the bimetallic arm 80 and the adjusting screw 82 to thus increase the precision of the desired adjustment.

As is further evident with reference to FIG. 2, the thermoswitch 42 includes a housing 86 to which the bimetallic arm 80 is attached, and a second threaded terminal 88 is fixedly secured to one end of the bimetallic arm 80 and extends outwardly from the housing 86 in the manner illustrated. In this regard, an electrical connection lead 90 may be attached to the second terminal 88 through the use of a nut 92, such lead being directable through an axially extending aperture 94 operably positioned between the hollow chambers 38, 40. The opposed end of the electrical connection lead 90 is then electrically connectible to a terminal 96 positioned on one end of the heating element 36. In this respect, the terminal 96 is fixedly secured to a first end 98 of the heating element 36, while a second end 100 of the heating element is fixedly attached in electrical communication with the heater body 30. To facilitate a secure and reliable electrical connection between the electrical connection lead 90 and the heating element 36, the end 98 of the heating element may be encased in an insulating material 102, and the insulating material may be concentrically positioned within a retaining cap or member 104 which is screwably attachable to a threaded portion 106 of the hollow chamber 38. Of course, it is to be understood that the electrical leads 68, 70 and 90 are all provided with suitable conventional insulation to insure against any short circuiting of the electrical components associated with the present invention. Accordingly, it will be realized that a closed circuit will exist at such time as the electrical contacts 76, 78 are in an abutting relationship thereby to activate the heating element 36.

To utilize the assembly 10 as above described, an operator need only to position it within a fuel tank 12, as illustrated in FIG. 1, and then supply electrical power thereto through an electrical connection lead 32. In this respect, the assembly 10 might selectively be dropped through the fuel filler pipe 14 or alternatively, it might be mounted in the tank 12 in a manner whereby a flexible conduit 35 is directed upwardly to a sealing ring 33, whereby the electrical connection lead 32 may be directed through the flexible conduit and into electrical communication with the assembly.

The operating characteristics of the heater 10 can be varied through the use of the adjustable thermoswitch 42, as illustrated in FIG. 2, whereby an adjusting screw 82 may be selectively moved to control the amount of spacing between the pair of contacts 76, 78. As the temperature of the fuel oil lowers the bimetallic arm 80 responds to the sensed drop in temperature by bringing the electrical contact 78 into an abutting relationship with the contact 76. When this abutting relationship between the contacts 76, 78 occurs, electrical power may be directed through the hot lead 70 into the bimetallic arm 80 so as to be further directed to an electrical connection lead 90 operably connected to a heating element 36. A ground lead 68 contained within the electrical connection lead 32 is operably connected to the aluminum heater body 30, while one end 100 of the heating element 36 is similarly connected to the heater body, thereby to complete the electrical circuit so as to cause the heating element 36 to rise in temperature and thus heat the fuel. Once the temperature of the fuel rises to a desired level, the bimetallic arm 80 again changes shape so as to effectively pull the contacts 76, 78 apart, thus cutting off the electrical power being supplied to the heating element 36.

With respect to the above description, it should be realized that the optimum dimensional relationships for the parts of the invention are deemed readily apparent and obvious to one skilled in the art to which the invention pertains, and all equivalent relationships to those illustrated in the drawings and described in the specification, to include modification of form, size, arrangement of parts and details of operation, are intended to be encompassed by the present invention. Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. In combination, a fuel oil tank and an immersion heating element assembly, said tank including a peripheral wall including a curved bottom having a fuel oil outlet communicated with the bottommost area thereof, said peripheral wall of the tank including a filler pipe and closure in an upper area thereof, said heating element assembly including an elongated body having end caps removably secured thereto, said end caps being of non-metallic material and having a cylindrical peripheral surface supporting the elongated body in horizontal position on the curved bottom of the tank with the body being immersed in the fuel oil in the tank, said body including a longitudinally extending cavity in each end thereof with the end caps forming sealed closures for the cavities, an electric heating element in one of said cavities, an electrical circuit connected with said heating element, said electrical circuit including a thermostatic switch mounted in the other of said cavities for opening and closing the electrical circuit in response to the temperature of the fuel oil in which the body is immersed, said electrical circuit including electrical conductors extending from the cavity having the thermostatic switch therein out through the end cap on that cavity in sealed relation thereto to preclude entry of fuel oil into the cavity, said electrical conductors extending through the wall of the tank in sealed relation thereto for connection with a source of electrical energy, one of said conductors having the thermostatic switch incorporated therein and connected to the heating element, the other of said conductors being electrically connected to the heating element so that the heating element is electrically energized when the thermostatic switch is closed and the conductors are connected to a source of electrical energy in order to heat the fuel oil in the tank in the area having the outlet associated therewith prior to the fuel oil leaving the tank, wherein said body is cylindrical and the cylindrical peripheral surface of each end cap includes a cylindrical flange telescoped over the cylindrical body at the end thereof and having a diameter greater than the body and being constructed of resilient plastic material and coacting rib and groove means extending peripherally of each end portion of the body and each end cap flange to provide a snap fit between the end cap and body, said thermostatic switch including adjustable contact means to vary the temperature at which the circuit is opened and closed, and wherein said body is constructed of conductive metal, said cavity receiving the heating element having an axial extension extending inwardly and receiving the heating element with one end of the heating element electrically connected to the body at the inner end of the extension with the conductor having the thermostatic switch therein being connected to the other end of the heatingelement, the other conductor being connected to said body within the cavity having the thermostatic switch therein.

2. An immersion heating element assembly for use in a fuel oil tank, said heating element assembly including an elongated body having end caps removably secured thereto, said end caps being of non-metallic material and having a cylindrical peripheral surface for supporting the elongated body in horizontal position on the bottom of the tank, said body including a longitudinally extending cavity in each end thereof with the end caps forming sealed closures for the cavities, an electric heating element in one of said cavities, an electrical circuit connected with said heating element, said electrical circuit including a thermostatic switch mounted in the other of said cavities for opening and closing the electrical circuit in response to the temperature of fuel oil in which the body is immersed, said electrical circuit including electrical conductors extending from the cavity having the thermostatic switch therein out through the end cap on that cavity in sealed relation thereto to preclude entry of fuel oil into the cavity, said electrical conductors being adapted for connection with a source of electrical energy, one of said conductors having the thermostatic switch incorporated therein and connected to the heating element, the other of said conductors being electrically connected to the heating element so that the heating element is electrically energized when the thermostatic switch is closed and the conductors are connected to a source of electrical energy, wherein said body is cylindrical and the cylindrical peripheral surface of each end cap includes a cylindrical flange telescoped over the cylindrical body at the end thereof and having a diameter greater than the body and being constructed of resilient plastic material and coacting rib and groove means extending peripherally of each end portion of the body and each end cap flange to provide a snap fit between the end cap and body, said thermostatic switch including adjustable contact means to vary the temperature at which the circuit is opened and closed, and wherein said body is constructed of conductive metal, said cavity receiving the heating element having an axial extension extending inwardly and receiving the heating element with one end of the heating element electrically connected to the body at the inner end of the extension with the conductor having the thermostatic switch therein being connected to the other end of the heating element, the other conductor being connected to said body within the cavity having the thermostatic switch therein.

* * * * *